US006702545B2

(12) United States Patent
Scholten

(10) Patent No.: US 6,702,545 B2
(45) Date of Patent: Mar. 9, 2004

(54) VENTURI FAN

(76) Inventor: Sanford Davis Scholten, 9901 Grassland Dr. #12, Louisville, KY (US) 40299

( * ) Notice: Subject to any disclaimer, the term of this patent is extended or adjusted under 35 U.S.C. 154(b) by 0 days.

(21) Appl. No.: 10/135,134

(22) Filed: May 1, 2002

(65) Prior Publication Data

US 2003/0206796 A1 Nov. 6, 2003

(51) Int. Cl.[7] ..... F01D 1/00

(52) U.S. Cl. ..... 415/1; 415/176; 415/211.2; 62/500; 62/401

(58) Field of Search ..... 415/1, 176, 177, 415/211.2, 222; 62/500, 401, 402; 29/889.2, 889.21, 889.22

(56) References Cited

U.S. PATENT DOCUMENTS 4,083,244 A * 4/1978 Agar et al. ..... 73/204
4,481,828 A * 11/1984 Cheng ..... 73/861.63
4,491,061 A * 1/1985 Nishizawa et al. ..... 98/34.6
4,786,301 A * 11/1988 Rhodes ..... 62/271

* cited by examiner

*Primary Examiner*—Edward K. Look
*Assistant Examiner*—J. M. McAleenan

(57) ABSTRACT

The invention is comprised of a venturi tube with a very narrow throat, a compressor fan at the intake end of said venturi tube, a blower fan at the output end, a plurality of turbinate fins on the interior of the intake end, and a means of heat dissipation on the exterior of the intake end of said venturi tube. Instead of a circular cross-section profile, the venturi tube has a cross-section of a polygon with no parallel sides, so that considerably less aerodynamic noise is generated than if the venturi tube's cross-section was circular. In addition, this cross-section results in variances in flow velocity along the cross-section, assuring continuous flow through the unit should a sonic choke occur at any point in the unit. The fans may be of any type and driven by any means appropriate to the respective model of the invention's application, i.e. by internally or externally mounted motor (s), power takeoff, belt drive from an external source of torque, etc. Gases are compressed into the intake end of the venturi tube by the compressor fan; the compressed gases rise in temperature.

2 Claims, 3 Drawing Sheets

*Side view cutaway of the venturi fan cooling device used to depict essential components and their positioning within the device.*

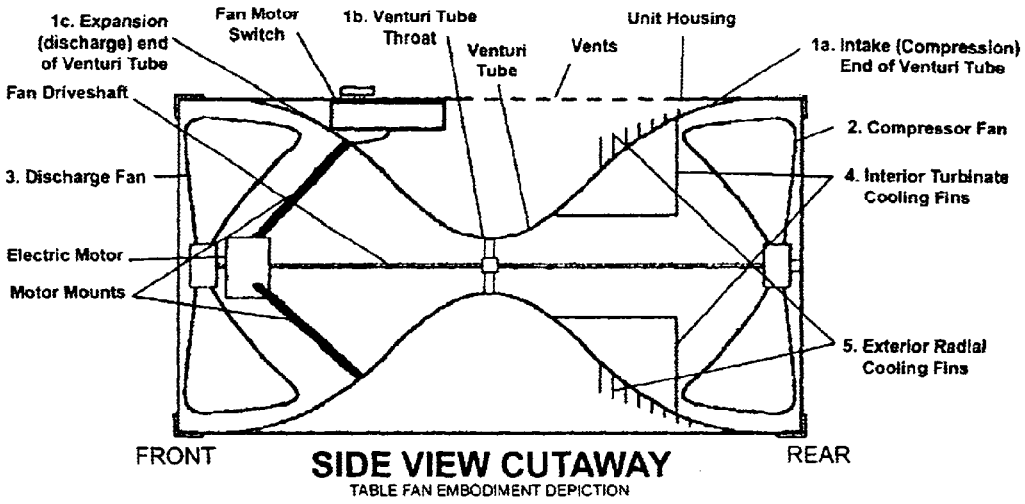
*Fig. 1. Side view cutaway of the venturi fan cooling device used to depict essential components and their positioning within the device.*

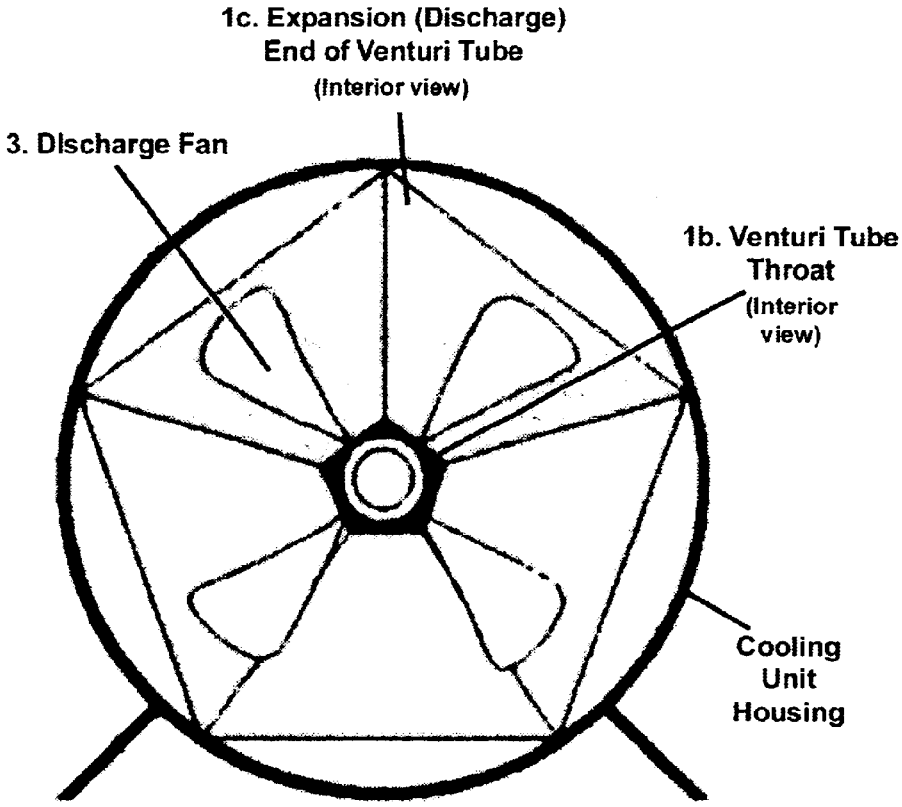

FRONT EXTERIOR VIEW

TABLE FAN EMBODIMENT SHOWN

*Fig. 2. Front exterior view of venturi fan cooling unit, including an interior view of the discharge end of the venturi tube and its profile along with other essential interior components as seen from the front exterior view. The interior view of the discharge end of the venturi tube is shown because the front view includes an opening of the venturi tube which exposes the interior.*

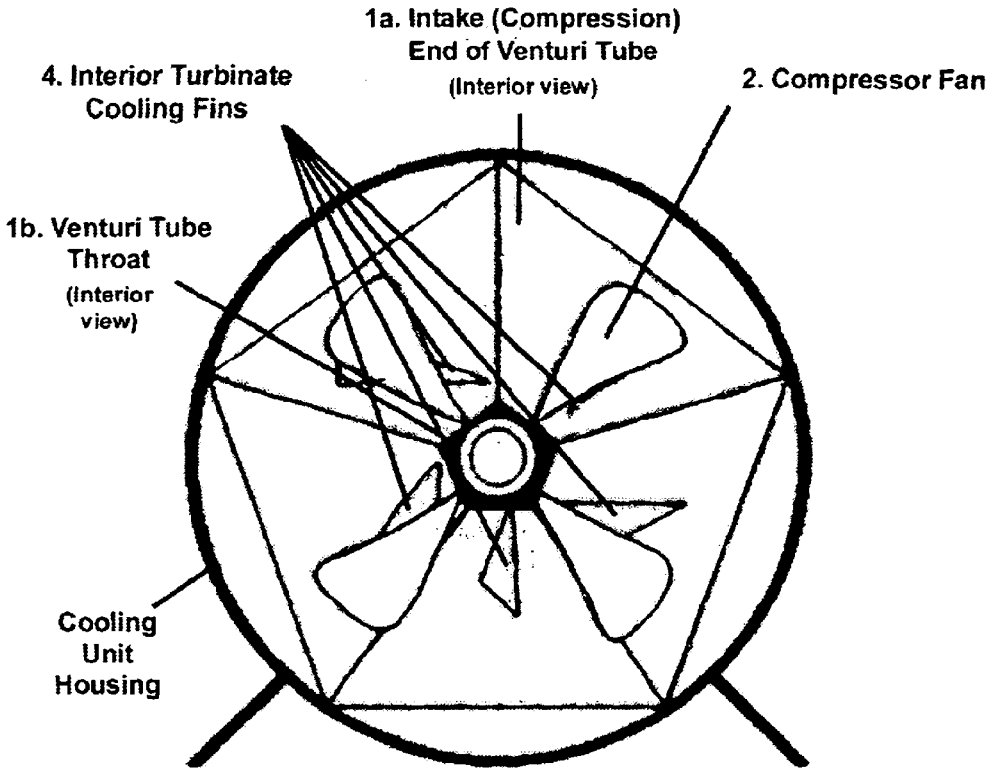

REAR EXTERIOR VIEW

TABLE FAN EMBODIMENT SHOWN

*Fig. 3. Rear exterior view of venturi fan cooling unit, including an interior view of the intake end of the venturi tube and its profile along with other essential interior components as seen from the rear exterior view. The interior view of the intake end of the venturi tube is shown because the rear view includes an opening of the venturi tube which exposes the interior.*

VENTURI FAN

FIELD OF INVENTION

This invention is designed for more effective cooling than, but with similar portability, cost, and ergonomics to, and applications of, traditional fan, fan/ducting, or fan/shroud cooling systems or apparatuses without the use of liquid refrigerant. In addition, the invention solves many problems that were inherent in the prior art.

BACKGROUND OF THE INVENTION

Cooling is a need that has been expressed throughout the history of the documented invention, and throughout this time various methods of cooling have been known, with some practiced more than others. The volume of art present indicates the intensity of the need for cooling; the nature of the art indicates a nearly universal objective: to develop, manufacture, and use cooling methods and systems that are effective, versatile, portable, reliable, low in maintenance, easily serviceable, and ergonomic—in addition to being affordable to design, manufacture, sell, and buy.

This objective has been met with varying degrees of partial success.

Various methods of gases refrigeration have been known for a long time, including gases as a refrigerant itself. It has also been known that gases temperature rises upon compression and falls upon expansion. Therefore, many inventions have sought to exploit this property. The basic method is to compress the gases, remove the extra heat from the compressed gases, and expand the gases to render refrigerated gases. The method is sufficiently sound for the art to have exploited this process from 1878 through the date of this writing and most possibly beyond. However, few if any of these devices have enjoyed much commercial success in manufacture and sale, for various reasons inherent in their designs. Judging by its claims, the first patent to exploit the properties of compressed and expanded gases was U.S. Pat. No. 198,830, a refrigerator from the 1870s that used a plunger to compress gases into a coil resembling a "worm" in a whiskey still; the worm rests in a chamber filled with cool gases or water and terminates in the chamber to be cooled. The resulting invention was a noisy one, and the plunger would need to be replaced periodically, rendering the invention costly to maintain and impractical, assuming that it was effective.

The concept of using compressed and expanded gases as a refrigerant in cooling chambers such as refrigerators, freezers, and rooms continued in the art throughout the $20^{th}$ century through to the date of this writing and beyond. The concept has proven especially effective as applied in cryogenic freezers to fast-freeze foodstuffs, as in U.S. Pat. Nos. 5,267,449 and 5,718,116, which use gases as the sole refrigerant. All of the aforementioned patents use variants of a system comprising of compressors, compression tanks, air-to-air or air-to-water heat exchangers, discharge vent(s), and requisite connecting tubing; some use one or more expansion tanks. Considering the tubing, which has a limited service life; the valves, which are prone to sticking and malfunction; the lack of portability, scalability and versatility; and the resultant unpleasant aerodynamic noise from a long distance of turbulent gases travel inside the tubing; units such as these are ergonomically deficient to the extent that units using liquid refrigerant are used in common practice, while cryogenic freezers are the only air-refrigerant devices in common use.

As most of the air-refrigerant devices in the art use systems of tubing and compressor tanks that are as bulky if not bulkier than their liquid-refrigerant equivalents, some of the art attempted to address this problem. U.S. Pat. No. 2,928,261, an air-refrigerant air conditioner for an automobile, reduces the system down to a compressor, tubing equipped with fins in the center, and an opening at the discharge end of the tube, which may be quipped with an optional expander turbine, which is driven by oil pressure. The system is a noisy one, considering the amount of turbulent airflow flowing through tubing terminating in a discharge end resembling the bell of a horn; the unit resembles a small trombone. In addition, the optional air expander driven by engine oil pressure would have introduced heat from the oil into the unit via conduction, rendering the unit ineffective. Finally, no provision is made for a sonic choke, so continuous airflow through the unit is not guaranteed.

The lack of commercial viability of air-refrigerant units has existed to the extent that liquid-refrigerant cooling systems have enjoyed far greater commercial success, as have simple convection fans when used in applications where liquid-refrigerant systems have been proven impractical due to size or cost. This phenomenon occurs despite the fact that, one, liquid-refrigerant systems are fraught with problems such as leakage of refrigerant that has known or presently unknown harmful effects; and two, conventional convection fans use no refrigeration by definition. In addition, conventional convection fans, occasionally with ducting systems, are relied upon to cool electronics when refrigeration is more desirable, especially during the current design trend toward more powerful machines, sometimes using heat-intensive 3-D chips, in smaller casings.

SUMMARY OF THE INVENTION

The venturi fan cooling system is a compact system that uses the proven method of cooling gases by compressing and expanding it, while simultaneously solving problems that prevented the prior art from becoming ergonomically acceptable to the public.

It has been very well known that it is possible for a venturi tube to be used to create a downdraft, and this knowledge has been frequently applied in the art. However, it is also known that, if the throat of the venturi tube is sufficiently narrow, then the constriction enables compression to build in the intake end of the tube if so desired. While there is still a small downdraft created, its proportion to the amount of gases that can be forced into the intake opening is so small that a significant amount of pressure can result. Therefore, the intake end of the venturi tube serves as a compression chamber. The narrow throat in the venturi tube also allows a fan to create a partial vacuum in the discharge end of the venturi tube by way of blowing gases out of the tube with a certain degree of force, thus creating an expansion chamber. The result is that a compression chamber, an expansion chamber, and transport means between the two can be integrated into a single compact unit simply by taking a venturi tube, narrowing the center, and furnishing means with which to force gases in and out of the tube. Gases can thus be compressed and expanded by a compact device while traveling a short distance. This benefits in greater operating efficiency and lower noise.

The heat resulting from compression can be removed while in the compression chamber, eliminating the need for a separate device to act as a heat exchanger. This is done by a plurality of turbinate cooling fins that are attached to the interior of the intake end of the venturi tube. As there is always a small downdraft occurring in the venturi tube, the gases in the entire unit are constantly moving. Therefore, gases can pass through the fins, which also promote turbulent flow to maximize heat transfer efficiency. The heat is transferred through the fins to the exterior of the intake end of the venturi tube, where it is dissipated via heat sink, liquid jacket, exterior cooling fins, or any other means or combination thereof.

As the gases pass through the constriction in the venturi tube, it travels at a very high velocity. It therefore loses pressure and therefore temperature. The lowered gas pressure and temperature are maintained in the discharge end of the venturi tube by means of turboexpansion. The discharge gases are therefore refrigerated.

It is known that all solid surfaces have acoustic properties. It is also known that parallel surfaces, when in the presence of gases that move in either a laminar or turbulent flow, create acoustic standing frequencies. These standing frequencies are amplified when a constriction, such as a venture tube throat, is present. The creation of these aural frequencies is desirable and therefore exploited in a musical instrument or other sound generator. However, when these frequencies or sounds are not desired, it is necessary to avoid placing acoustically reflective surfaces in parallel. In the instance of a tube, it is necessary to note that a tube with a round cross-section has an infinite number of parallel surfaces; one with a square, rectangular, or rhomboid cross-section has two sets of two parallel surfaces, and any tube with the cross-section of a perfect polygon with an even number of sides has that number of parallel surfaces. In any of these cases, when gases travel through any of these tubes, noise will be generated from the standing frequencies created by the parallel surfaces. Conversely, a tube that has a cross-section of a shape with no parallel surfaces, such as a polygon with an odd number of sides, will not generate any standing frequencies when gases moves inside it and the resultant noise will be significantly less than that generated by a tube with parallel surfaces. An additional benefit of this design is that, due to the resulting variances in actual diameter of the venture tube throat, flow velocity will be less at the wider points and more at the narrower points. As a result, should a sonic choke occur at one point, continuous flow is assured at another point.

Therefore, the venturi tube has no parallel surfaces within so that a minimum of noise is generated by the movement of gases inside the tube.

Preferred Embodiments of the Invention

This invention was conceived to be versatile and usable in many applications. This is made possible by the compact arrangement of all components of the invention. The invention can also be scaled to a size that is sufficiently large or small to accommodate the needs of each respective application.

The invention can be a freestanding unit of any size, or it can also be built into an existing structure. It can also be built into machines, or models can be designed to retrofit into machines in order to replace conventional convection-type fans. It may also be built into an HVAC or refrigeration system, or used inline in a piping or flue system to cool compressible gases where such cooling is desired.

The fans in the system can be of any type, and driven by any means. If the venturi fan is used in a ducting, pipe, or flue system, the fans may be located in the ducting instead of the venturi tube, provided that the fans still force gases into the tube and turboexpand the gases out of it.

While specific embodiments of the present invention have been described, it will be apparent to those skilled in the art that various modifications can be made without departing from the spirit, scope, and general intention of the present invention as defined in the appended claims.

BRIEF DESCRIPTION OF THE DRAWINGS

This device is explained in two drawing figures.

FIG. 1 depicts a cutaway side view of the device to describe the nature and position of the components.

FIG. 2 depicts a front and rear view of the device to show the cross-section profile of the venture tube and to describe a more specific position of the interior turbinate cooling fins. An exploded view is not included, as it is not beneficial in the description of the device due to the integrated nature of the components of the device.

FIG. 3 depicts a rear exterior view of venturi fan cooling unit that includes an interior view of the intake end of the tube and its profile. The interior view of the intake end of the venturi tube is shown because the rear view includes an opening of the venturi tube which exposes the interior.

DETAIL DESCRIPTION OF THE INVENTION

The embodiment of the invention shown is that of a basic table fan model. It is necessary to emphasize that various embodiments of this invention can vary in appearance. Therefore, components that are numbered are used in all embodiments of the invention, and components that are not used in all embodiments of the invention and are not absolutely necessary to its operation are not numbered. The sole exception is component 5, the Exterior Radial Cooling Fins; while the function of these fins is absolutely necessary to the operation of this embodiment of the invention, the fins may be substituted by a cooling liquid jacket, heat sink, or any other means of heat dispersal on this or any other embodiment of the invention.

The components are as follows:

1. Venturi Tube in its entirety.

1*a*. Intake end of the venturi tube, where gases are mechanically compressed.

1*b*. Venturi tube throat, which is essentially narrow enough to allow gases to be mechanically compressed in one end and expanded in the other.

1*c*. Discharge end of the venture tube, where gases are mechanically expanded.

2. Compressor fan, which mechanically compresses the gases in component 1*a*. This fan may be of any type, be driven by any means, use any method to compress the gases, and be of any appearance.
3. Discharge fan, which mechanically expands the gases in component 1*c*. This fan may be of any type, be driven by any means, use any method to expand the gases, and be of any appearance.
4. Interior turbinate cooling fins, which serve two functions: to disperse heat from the compressed gases, and to promote turbulent flow within component 1*a*.
5. Exterior radial cooling fins, which further disperse the heat, from the compressed gases in component 1*a*, which has been removed from the compressed gases and conducted through component 4. As previously stated, a liquid cooling jacket, heat sink, or any other means of heat dispersal may be substituted for the radial cooling fins.

Not numbered: Electric motor, motor mounts, fan driveshaft, and fan motor switch, all of which demonstrate a method to power and control the fans.

Not numbered: Unit housing with vents, demonstrating a method to mount or present the unit.

What is claimed is:

1. A compact cooling system which cools by compressing gases, cooling it, and expanding it without the express need for liquid refrigerant while avoiding generating excess noise; the compact cooling system comprises of:

an axial venturi tube (1), constructed of heat-conducting material, with a cross-section of a polygon with an odd number of sides or other shape having no parallel sides, said venturi tube (1) having a center constriction **(1*b*) which is narrow enough to allow gases compression to occur in one end, said venturi tube (1) also having cooling fins (4) arranged in a turbinate fashion and attached to the interior of the end of the venturi tube designated for gases intake and compression (1*a*)**;

said venturi tube (1) having a means of heat dispersal (5) located at the exterior of the end of the venturi tube designated for gases intake and compression **(1*a*)**;

said venturi tube (1) having means (2) to force gases into the end of the tube designated for gases intake and compression **(1*a*)**;

said venturi tube (1) having means (3) to force gases out of the end of the tube designated for gases expansion and discharge **(1*c*)**.

2. A method for cooling, including steps for:

modifying an axial venturi tube by narrowing the center throat of the tube to a predetermined specification, provides a small venturi downdraft to occur, wherein gas is compressed by forced gases in one half of the venturi tube, while in the other half of the venturi tube, turboexpansion occurs through outwardly forced gases, wherein both the compression of gases by forced gases in one half of the tube and the outwardly forced gases from turboexpansion in the other half of the tube occur simultaneously or occur near to simultaneously;

by compressing and cooling the gases simultaneously results in less space, less materials for construction and less energy required to move the gases;

wherein the means for turbulent flow within the compression end of the unit and dissipating heat simultaneously, results in maximum cooling efficiency;

wherein the elimination of parallel reflective acoustic surfaces results from the venturi tube having a cross-section shape of a polygon with an odd number of sides and no parallel sides, preventing the generation of standing frequencies when the gases move inside the tube that provides significantly less noise than a tube with parallel surfaces; whereby the elimination of parallel reflective acoustic surfaces reduces the generation of excess aerodynamic noise, eliminates the need for using noise-retardant surfaces that compromise the effectiveness and efficiency, and assures continuous flow in the system in the event of a sonic choke;

wherein the venturi tube has cooling fins attached to the interior of the end of venturi tube designated for the gases intake and compression;

wherein the venturi tube has means of heat dispersal located at the exterior of the end of the venturi tube designated for the gases intake and compression;

wherein the venturi tube has means to force gases into the end of the venturi tube designated for the gases intake and compression;

wherein the venturi tube has means to force gases out of the end of the venturi tube for gases expansion and discharge.

* * * * *